US006102627A

United States Patent [19]

Ueda et al.

[11] Patent Number: 6,102,627

[45] Date of Patent: Aug. 15, 2000

[54] PILE FOUNDATION STRUCTURE

[75] Inventors: Sakae Ueda, Sanda; Eiichi Tsuji, Osaka, both of Japan

[73] Assignee: Nippon Pillar Packaging Co., Ltd., Osaka, Japan

[21] Appl. No.: 09/147,118

[22] PCT Filed: Feb. 5, 1998

[86] PCT No.: PCT/JP98/00495

§ 371 Date: Oct. 9, 1998

§ 102(e) Date: Oct. 9, 1998

[87] PCT Pub. No.: WO98/36130

PCT Pub. Date: Aug. 20, 1998

[30] Foreign Application Priority Data

Feb. 14, 1997 [JP] Japan ..... 9-047050
Feb. 14, 1997 [JP] Japan ..... 9-047051

[51] Int. Cl.[7] ..... F02D 27/34

[52] U.S. Cl. ..... 405/255; 405/229; 52/167.9; 52/167.4

[58] Field of Search ..... 405/229, 230, 405/231, 255; 52/167.1, 167.4, 167.7, 167.9, 299, 295

[56] References Cited

U.S. PATENT DOCUMENTS 3,105,252 10/1963 Milk ..... 52/167.7
4,121,393 10/1978 Renault et al. ..... 52/167.9
4,163,621 8/1979 Higuchi ..... 405/255
4,320,549 3/1982 Greb ..... 52/167.9
4,644,714 2/1987 Zayas ..... 52/167.4
5,014,474 5/1991 Fyfe et al. ..... 52/167.9

FOREIGN PATENT DOCUMENTS 50-97107 8/1975 Japan .
63-289124 11/1988 Japan .
8-120687 5/1996 Japan .

*Primary Examiner*—Eileen Dunn Lillis
*Assistant Examiner*—Frederick L. Lagman
*Attorney, Agent, or Firm*—Jones, Tullar & Cooper, P.C.

[57] ABSTRACT

The present invention relates to a technique wherein a sliding member is disposed between a supporting portion formed on a head of a pile and a binding portion formed on a bottom of a footing. Thus, the binding portion of the head of the pile acts as a roller bearing structure or a pin structure, thereby making it possible to relatively slidingly move in a horizontal direction or slidingly rotate the footing and the pile. As a result, the present invention can prevent damage or destruction in applying a great external force such as an earthquake to the structure, enhance execution and achieve low-cost by means of decreasing the amount of reinforcing steel used.

14 Claims, 5 Drawing Sheets

PILE FOUNDATION STRUCTURE

TECHNICAL FIELD

The present invention relates to a pile foundation structure for supporting a footing serving as a foundation of an upper structure a and propagating a load of the upper structure to the underground depths by means of a point bearing pile or a friction pile being driven into the underground such, as a solid rock.

BACKGROUND ART

Such a a pile foundation structure conventionally known is a structure illustrated in FIG. 4.

In other words, it has a structure wherein a point pile or a friction pile 82 as a structural element, is driven into the underground 81, such as solid rock, a bottom of a footing 83 is mounted on the head of the pile 82, and the pile 82 and the footing 83 are rigidly bound by a reinforcing steel members 84 including a pile reinforcement and a concrete-reinforcing bar and concrete.

In the case of the conventional pile foundation structure as mentioned above, having an arrangement wherein the pile 82 and the footing 83 are rigidly bound, when an external force such as an earthquake is applied, the underground 81 including the ground and the upper structure are separately moved, whereby a load including a shearing force and a bending moment or the like is concentrated on a binding portion of the head of the pile being a boundary portion therebetween. Consequently, a problem arises wherein the head of the pile 82 and the footing 83 maybe damaged and even destroyed. The pile foundation structure itself is a bottom portion structure supported by the pile 82 of the structure element driven into the underground. As a result, it is extremely difficult and requires a long period and huge costs to conduct a restoration construction in case damage or a destruction is caused on the head of the pile 82 and the footing 83.

In order to resolve the above problems, the pile foundation structure employing a sliding structure has been suggested in Japanese Patent Laid-open No. 1-102124.

In other words, the pile foundation structure is like that shown in FIG. 5; and structurally described below. A number of steel reinforcement members 92 annularly disposed on an upper end of a concrete pile 91, and steel pipes 93 surrounding the steel reinforcement members 92 in a state of allowing lateral movement of the steel reinforcement members 92 are upwardly extended. At the lower end portion of the steel pipes 93, annular engagement projections 94 are arranged so as to be connected to an upper end portion of the concrete pile 91 in a buried state. Moreover, a top board 95 is welded to the upper end portion of the steel pipes 93. The top board 95 is provided with flexible holes 96 for making the steel reinforcement members 92 pierce the top board 95 so as to respectively allow lateral shaking of the steel reinforcement members 92. The steel reinforcement members 92 protruding above the top board 95 through the flexible holes 96, are connected to the concrete structure body (or the footing) 97 of the upper portion thereof. Furthermore, there is interposingly a sliding member 99 between the top board 95 and a footing metal member 98, through which the concrete structure body 97 is slidably mounted on the top board 95.

In the pile foundation structure having such a sliding arrangement, when an external force, such as an earthquake, is applied, the steel reinforcement members 92 are bent, and at the moment while they are bent, the sliding member 99 makes the concrete structure body 97 slidingly move with respect to the concrete pile 91, thereby making it possible to restrict the load concentration of the bending moment or the like on the binding portion of the pile head. However, a sliding amount is regulated by the size of each flexible hole 96 disposed on the top board 95, and the concrete pile 91 is connected to the concrete structure body 97 by the steel reinforcement members 92, whereby a shearing force and the bending moment cannot be efficiently absorbed, in the case of applying the excess external force such as the earthquake. Consequently, it is unavoidable that the head of the pile 91 and the concrete structure body 97 is damaged or destroyed. In the same way as the conventional pile foundation structure in FIG. 4, there has been a problem wherein the earthquake-proof property and earthquake avoidable property cannot be ensured enough.

SUMMARY OF THE INVENTION

The present invention has been conducted in view of the above mentioned circumstances, i.e., the background of the prior art. An object of the present invention is to provide a pile foundation structure which can prevent damage or destruction of the pile head and a footing by releasing a stress applied to a binding portion of a pile head, even in applying a great external force such as the earthquake, enhance execution and achieve low-cost by means of decreasing an amount of arrangement of reinforcing steel employed for the pile and the footing.

In a pile foundation structure according to a first aspect of the present invention, a pile foundation structure having a footing arranged on a side of a head of a pile in the underground comprises:

- a protrusive supporting-portion having a flat top surface, disposed on the head of the pile so as to protrude above an upper surface of the underground,
- a recessed binding-portion having a flat top surface, disposed on a bottom portion of the footing separated from the pile so as to correspond to the protrusive supporting-portion and be greater than the corresponding protrusive supporting-portion, and
- a sliding member interposed between the flat top surfaces of the protrusive supporting-portion and the recessed binding-portion, thereby building a roller bearing structure making it possible to relatively slidingly move the binding portion of the head of the pile in a horizontal direction.

According to a first aspect of the present invention having such an arrangement, a sliding member is interposed between the flat top surfaces of the protrusive supporting-portion disposed on the pile head portion and the recessed binding-portion disposed on the bottom of the footing, the top surfaces are opposed to each other, thereby building a roller bearing structure making it possible to relatively slidingly move the binding portion of the head of the pile in a horizontal direction. Whereby it is possible to prevent a load of a shearing force, a bending moment or the like from being concentrated on the binding portion of the pile head in applying the external force. Consequently, even in applying a great external force such as the earthquake, the roller bearing structure can prevent the pile head and the footing from being damaged or destroyed, thereby making it possible to decrease an amount of an arrangement of reinforcement used for the pile and footing, thereby enhancing execution and achieving low-cost as effects.

According to a second aspect of the present invention, a pile foundation structure having a footing arranged on a side of a head of a pile in the underground comprises:

a spherical-supporting-portion being convex or concave shaped, disposed on the head of the pile so as to protrude above an upper surface of the underground, a spherical-binding-portion being convex or concave shaped, disposed on a bottom portion of the footing separated from the pile so as to correspond to the spherical-supporting-portion and be greater than the corresponding spherical-supporting-portion, and a sliding member interposed between an outer surface of the spherical-supporting-portion and an inner surface of the spherical-binding-portion, thereby building a pin bearing structure making it possible to relatively slidingly rotate the binding portion of the head of the pile.

Also, according to the second aspect of the present invention having such an arrangement, there are oppositely an inner surface of the convex or concave spherical-supporting-portion disposed on the pile head and an outer surface of the convex or concave spherical-binding-portion disposed on the bottom portion of the footing, the sliding member is interposed therebetween, thereby building the pin bearing structure making it possible to relatively slidingly rotate the binding portion of the pile head. When the external force is applied, a stress is released by sliding rotation, thereby making it possible to prevent the bending moment from concentrating on the binding portion of the pile head. Therefore, even in applying a great external force such as the earthquake, it can prevent the pile head portion and the footing from being damaged or destroyed, thus making it possible to decrease the amount of arrangement of reinforcing steel used for the pile and the footing. Consequently, as effects, the execution is enhanced and the low-cost is achieved.

According to the first and second aspects of the present invention having the above structures, in the case that a crushed-stone layer for supporting the footing so as to be horizontally movable, is formed between a bottom surface of the footing and the upper surface of the underground, the binding portion of the pile head is isolated from the ground, the earthquake motion of the ground is decreased, thereby showing an earthquake avoidable effect for preventing shaking from being propagated to the footing and the upper structure. The seismic force and a lateral shake of the upper structure are extremely decreased, thus obtaining improvement of the livability and enhancing further a damage-preventive effect of the upper structure.

Moreover, the pile foundation structure according to the first and second aspects of the present invention has an arrangement wherein a calking compound is enclosed with the sliding surface between the supporting portion of the head of the pile and the binding portion of the bottom portion of the footing. The calking compound is enclosed with the sliding surface between the supporting portion of the head of the pile and the binding portion of the bottom portion of the footing, thereby enhancing the vibration absorption property, and making it possible to prevent water from intruding from an outside to the sliding surface. Accordingly, corrosion of a steel material as a structural element is decreased and deterioration of the sliding member is decreased, thereby keeping sliding movement and sliding rotation properties caused by the sliding member smooth and stable for a long period as effects.

Furthermore, the pile foundation structure according to the first and second aspects of the present inventions has an arrangement wherein metal parts are respectively fitted in an outer surface of the supporting portion of the head of the pile and an inner surface of the binding portion of the bottom portion of the footing in a closing state, and the metal parts are integrally connected to the head of the pile and the bottom of the footing via anchor members. Then, the arrangement can surely prevent the pile head and footing from being destroyed or damaged and keep predetermined sliding movement and sliding rotation properties smooth and stable.

In addition, according to the pile foundation structure of the first and second aspects of the present inventions having the above structures, a material having a self-lubricative property is employed as the sliding material. Therefore, even in the case that this is the first time that the structure wherein a long time passed since the execution of the structure has undergone the external force such as the earthquake, the predetermined sliding movement and sliding rotation properties are ensured.

DESCRIPTION OF THE PREFERRED EMBODIMENTS

Figure 1:
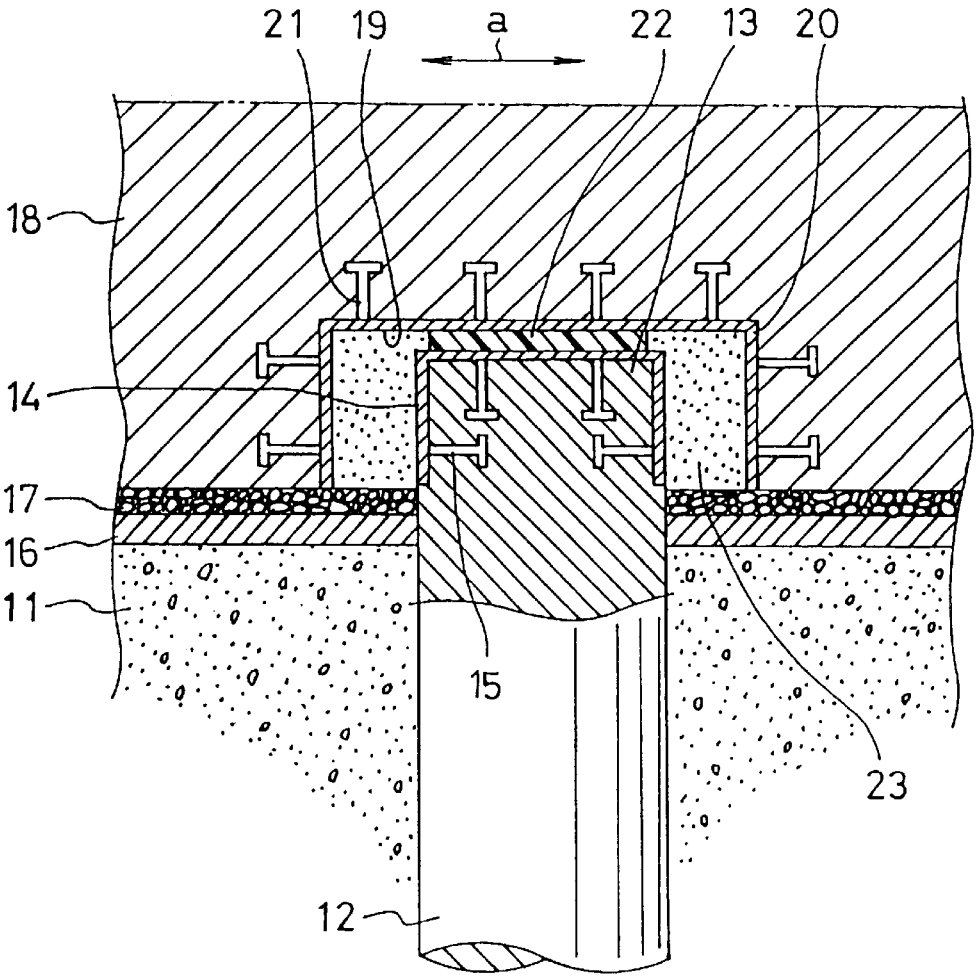
FIG. 1 is a longitudinal sectional view of a main portion showing a pile foundation structure according to a first embodiment of the present invention.

Referring now to the drawing, preferred embodiments of the present invention are described below.

A first embodiment is described. A pile foundation structure shown in FIG. 1 has an arrangement wherein a long pile 12 made of reinforced concrete is driven into the underground 11, such as solid rock. A head of the pile 12 (or a pile head) is provided with a columnar protrusive supporting-portion 13 having a flat top surface so as to protrude above an upper surface of the underground 11. A pile metal part 14 made of a protrusive-seat-shaped metal (mainly steel) corresponding thereto is closely fitted in an outer surface of the protrusive supporting-portion 13 of the pile head. Additionally, an inner surface of the pile metal part 14 is integrally fixed and connected to the head of the pile 12 via a number of anchor members 15 made of steel, for fixation.

A mortar seat 16 and a crushed-stone layer 17 for supporting a footing described later so as to be movable in a horizontal direction, are laminated on an upper surface of the underground 11. A portion corresponding to the head of the pile 12, in the crushed-stone layer 17 and a bottom of the footing (or a foundation of an upper structure) 18 made of reinforced concrete disposed on the head of the pile 12, is provided with a cylindrical recessed-binding-portion 19 having a flat top surface so as to have a greater diameter than that of the protrusive supporting-portion 13 corresponding thereto.

The footing 18 is not linked to the pile 12 by reinforcement. The footing 18 is structurally separated from the pile 12. A footing metal part 20 made of a recessed seat-shaped metal (mainly steel) corresponding thereto is closely fitted in an inner surface of the recessed-binding-portion 19 on the bottom of the footing 18, and the outer surface of the footing metal part 20 is integrally fixed and connected to the bottom of the footing 18 via a number of anchor members 21 made of steel, for fixation.

A sliding member 22 is disposed between the flat top surfaces of the pile metal part 14 fitted and fixed in the protrusive supporting-portion 13 on a side of the pile 12 and the footing metal 20 fitted and fixed in an inside of the recessed-binding-portion 19 on a side of the footing 18, thereby building a roller bearing structure for making it possible to relatively slidingly move the binding portion of the pile head in a horizontal direction, and an enclosing structure wherein a calking compound 23 is enclosed with a sliding surface (i.e., a clearance portion except a portion for disposing the sliding member 22) between the protrusive supporting-portion 13 on a side of the pile 12 and the recessed-binding-portion 19 on a side of the footing 18.

For use, the sliding member 22 is adhesively bonded to a resin sheet made of a fluororesin or a polyethylene resin or the like, or it is coated with the fluororesin or the polyethylene resin. In addition, a solid lubricating material including carbon material and molybdenum material may be applied to the sliding surface of the resin sheet. Anyway, as the sliding member 22, a material having self-lubricating property is employed.

Preferably, a material employed as a calking compound 23 is a sealant material, a rubber packing or the like, having superiority in a cut-off of water property and a vibration absorbing property.

As the pile foundation structure arranged as mentioned above, a roller bearing structure is adopted wherein the pile metal part 14 is fitted and fixed in the protrusive supporting-portion 13 on a side of the head of the pile 12 and the footing metal part 20 is fitted and fixed in the recessed-binding-portion 19 on a side of the bottom of the footing 18, the flat top surfaces of the pile metal mart 14 and the footing metal part 20 are opposite to each other. The sliding member 22 having the self-lubricating property is interposed between the flat top surfaces. Therefore, the bottom of the footing 18 and the head of the pile 12 are relatively slidingly movable in laterally and longitudinally horizontal directions (i.e., a direction of an arrow "a" in FIG. 1, and a cross dot direction).

As a result, in applying stress to the pile head binding portion, they relatively slidingly move in a horizontal direction, thereby exhibiting a function of releasing the stress, and preventing shearing force and bending moment applied to the binding portion of the pile head from occurring. Accordingly, even in applying a great external force such as an earthquake, the present invention can prevent the head of the pile 12 and the footing 18 from being damaged and destroyed, thereby ensuring an earthquake proofing property, and an earthquake avoidable property, whereby the amount and arrangement of the reinforcement, employed as the pile 12 and the footing 18, can be decreased and execution can be enhanced and costs thereof can be decreased.

Furthermore, the crushed-stone layer 17 is formed on a side of the lower surface of the footing 18. Accordingly, the pile foundation structure is isolated from the underground 11, and the earthquake avoidable property is exhibited, thereby improving livability owing to extremely decreasing the seismic force and a lateral shake of the upper structure, and further enhancing damage-preventing-effects of the upper structure.

Moreover, structurally, the calking compound 23 is enclosed with the sliding surfaces disposed between the protrusive supporting-portion 13 of the head of the pile 12 and the recessed-binding-portion 19 of the bottom of the footing 18, whereby the calking compound 23 enhances the vibration absorbing property, and prevents water or the like from intruding into the sliding surface from the outside. As a result, the structure can reduce corrosion of steel materials as element materials including the pile metal part 14 and the footing metal part 20, and deterioration of the sliding member 22, and it can keep the sliding movement property of the sliding member 22 smooth and stable for a long time.

Figure 2:
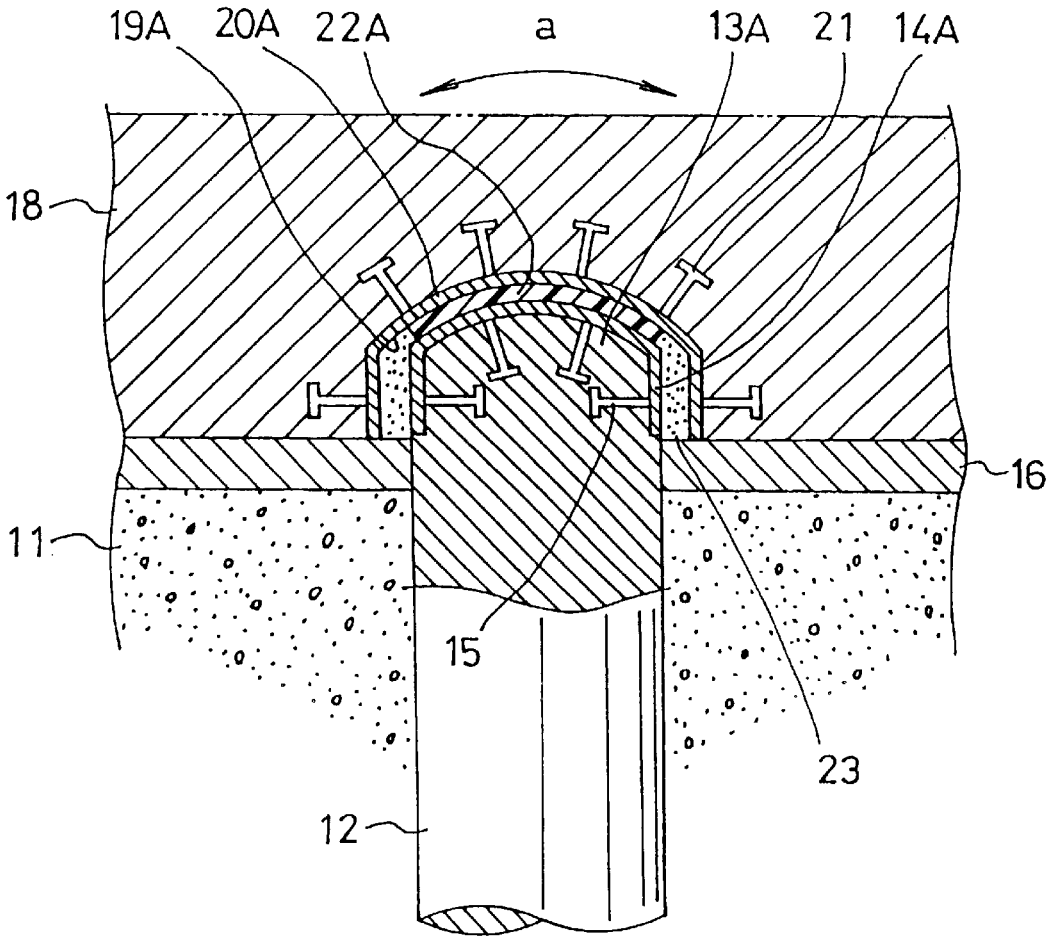
FIG. 2 is a longitudinal sectional view of a main portion showing a pile foundation structure according to a second embodiment of the present invention.

A second embodiment shown in FIG. 2 is described. In the pile foundation structure in the second embodiment, the head of the pile 12 made of reinforced concrete is provided with a spherical-supporting-portion 13A being convex shaped, having a spherical top surface, so as to protrude above an upper surface of the underground 11. In an outer surface of the spherical-supporting-portion 13A, a convex seat-shaped pile metal part 14A corresponding thereto is fitted and fixed. On the bottom of the footing 18 made of reinforced concrete, a concave spherical-binding-portion 19A having a spherical top surface is disposed, so as to correspond to the convex spherical-supporting-portion 13A of the head of the pile 12 and have a greater diameter than that of the corresponding spherical-supporting-portion 13A. In the inner surface of the spherical-binding-portion 19A, a footing metal part 20A being concave seat-shaped, corresponding thereto, is fitted and fixed. Between vertically opposite spherical surfaces of the pile metal part 14A on a side of the pile 12 and the footing metal part 20A on a side of the footing 18, a sliding member 22A is interposed, thereby making a pin bearing structure for making it possible to relatively slidingly rotate the binding portion of the pile head, and forming only the mortar seat 16 on the upper surface of the underground 11, which are different from the first embodiment. As to the other arrangements, the second embodiment is identical to the first one. Then, the identical references are allocated to portions in the second embodiment corresponding to portions in the first embodiment and detail descriptions thereof are omitted.

Also, in the pile foundation structure having an arrangement shown in the second embodiment, the bottom of the footing 18 and the head of the pile 12 can be relatively slidingly rotated along the spherical-supporting-portion 13A and the spherical-binding-portion 19A in all directions (i.e., a direction of an arrow "a" in FIG. 2). Accordingly, sliding rotation in applying stress to the binding portion of the pile head makes a property of releasing the stress shown, and can prevent a bending moment applied to the binding portion of the pile head from occurring. Consequently, even in the case of applying a great external force such as the earthquake to the structure, it can prevent the head of the pile 12 and the footing 18 from being damaged or destroyed to ensure the earthquake proofing property and the earthquake avoidable property. Therefore, this can decrease the amount of arrangement of reinforcement employed for the pile 12 and the footing 18, enhance execution and decrease cost.

Furthermore, the calking compound 23 is enclosed with the sliding surface between the convex spherical-supporting-portion 13A of the head of the pile 12 and the concave spherical-binding-portion 19A of the bottom of the footing 18. The calking compound 23 enhances the vibration absorbing property, and prevents water or the like from intruding from the outside to the sliding surface. Therefore, this can decrease corrosion of the steel material as the element materials including the pile metal part 14A and the footing metal part 20A, and deterioration of the sliding member 22A, and keep the property of the sliding movement of the sliding material 22A smooth and stable for a long time.

Figure 3:
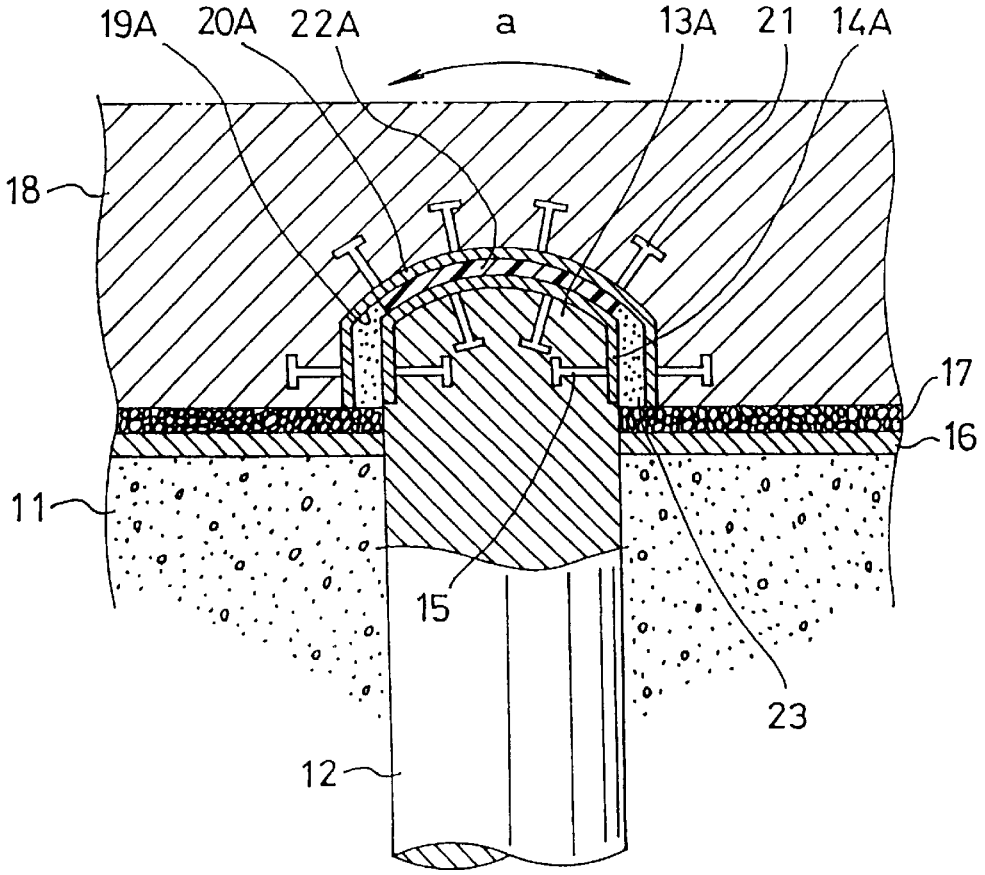
FIG. 3 is a longitudinal sectional view of a main portion showing a pile foundation structure according to the second embodiment of the present invention.
Figure 4:
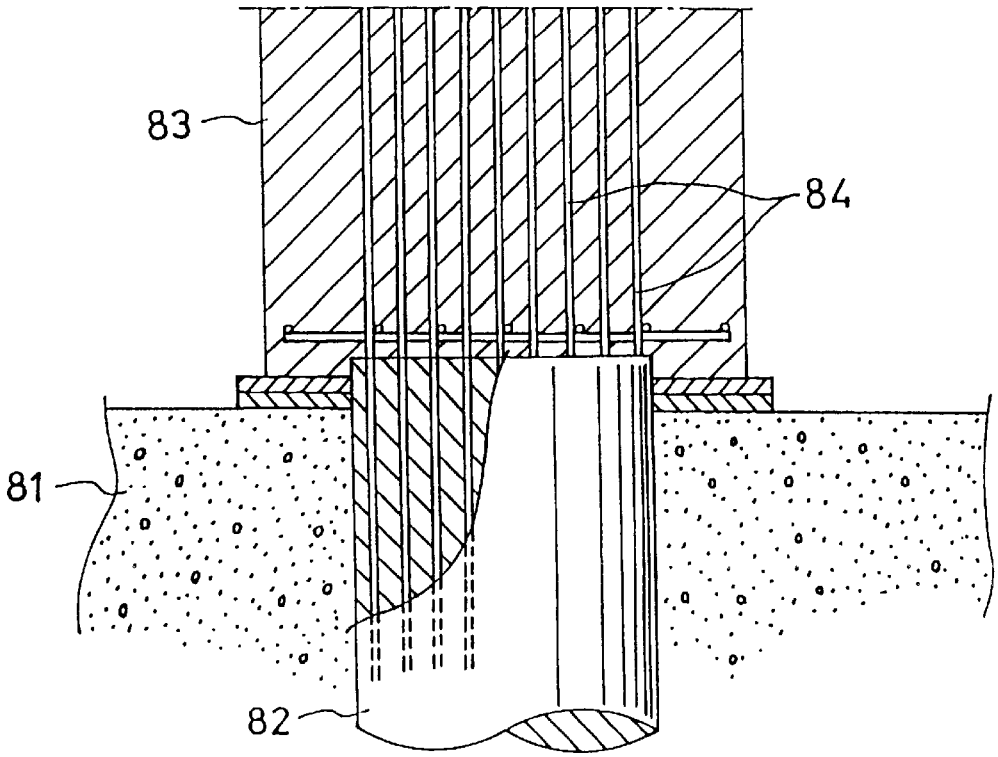
Fig. 4 (PRIOR ART)
FIG. 4 is a longitudinal sectional view of a main portion showing a general pile foundation structure according to the prior art.
Figure 5:
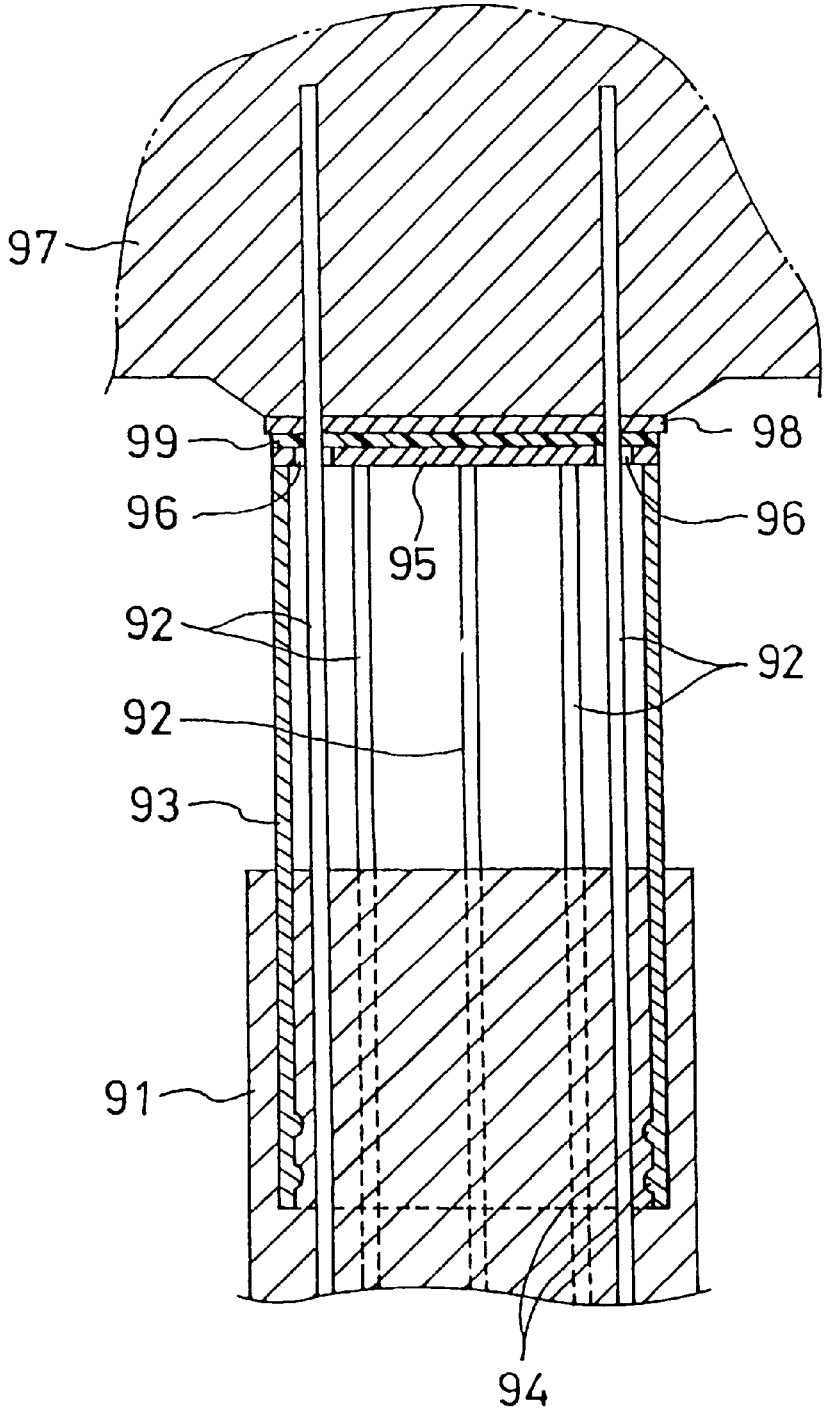
Fig. 5 (PRIOR ART)
FIG. 5 is a longitudinal sectional view of a main portion showing a pile foundation structure already suggested in the prior art.

The pile foundation structure of a third embodiment shown in FIG. 3 is described below. The pile foundation structure of the third embodiment has an arrangement wherein the crushed-stone layer 17 for supporting the footing 18 as well as the mortar seat 16, so as to be movable in a horizontal direction, is laminated between the upper surface of the underground 11 and the lower surface of the footing 18. The pile foundation structure of the third embodiment ensures the same effect as the pile foundation structure of the second embodiment does, and the pile foundation structure is isolated from the underground 11, thereby exhibiting the earthquake avoidable property with the result that the seismic force and the lateral shaking of the upper structure are extremely reduced. Accordingly, livability is improved, and the damage preventive effect is further enhanced.

Though the second and third embodiments as mentioned above have the structure wherein the spherical-supporting-portion 13A of the head of the pile 12 is formed in a convex shape and the spherical-binding-portion 19A of the bottom of the footing 18 is formed in a concave shape, they may have the reversed structure wherein the spherical-supporting-portion 13A of the head of the pile 12 is formed in a concave shape and the spherical-binding-portion 19A of the bottom of the footing 18 is formed in a convex shape. Then, the latter structure can have the same action and effect as the former one.

As mentioned above, the pile foundation structure according to the present invention relates to a technique wherein a roller bearing structure or a pin structure is disposed between a supporting portion of a head of a pile for propagating a load of an upper structure to the underground depths and a binding portion of a bottom of a footing, thus preventing the pile and the footing from being damaged or destroyed owing to stress concentration applied to the binding portion of the pile head in applying a great external force such as an earthquake to the structure, making it possible to reduce the amount of, and arrangement of the reinforcement. Consequently, the technique can enhance execution and realize low-cost.

What is claimed is:

1. A pile foundation structure having a footing arranged on a side of a head of a pile in the underground comprising:

a protrusive supporting-portion having a flat top surface, disposed on the head of the pile so as to protrude above an upper surface of the underground, a recessed binding-portion having a flat top surface, disposed on a bottom portion of the footing separated from the pile so as to correspond to the protrusive supporting-portion and be greater than the corresponding protrusive supporting-portion, and a sliding member interposed between the flat top surfaces of the protrusive supporting-portion and the recessed binding-portion, thereby building a roller bearing structure for making it possible to relatively slidingly move the binding portion of the head of the pile in a horizontal direction.

2. A pile foundation structure according to claim 1, wherein a crushed-stone layer for supporting the footing so as to be horizontally movable, is formed between a bottom surface of the footing and the upper surface of the underground.

3. A pile foundation structure according to claim 2, wherein a calking compound is enclosed with the sliding surface between the supporting portion of the head of the pile and the binding portion of the bottom portion of the footing.

4. A pile foundation structure according to claim 3, wherein metal parts made of a metal are respectively fitted in an outer surface of the supporting portion of the head of the pile and an inner surface of the binding portion of the bottom portion of the footing in a closing state, and the metal parts are integrally connected to the head of the pile and the bottom of the footing via anchor members.

5. A pile foundation structure according to claim 2, wherein metal parts made of a metal are respectively fitted in an outer surface of the supporting portion of the head of the pile and an inner surface of the binding portion of the bottom portion of the footing in a closing state, and the metal parts are integrally connected to the head of the pile and the bottom of the footing via anchor members.

6. A pile foundation structure according to claim 1, wherein a calking compound is enclosed with the sliding surface between the supporting portion of the head of the pile and the binding portion of the bottom portion of the footing.

7. A pile foundation structure according to claim 6, wherein metal parts made of a metal are respectively fitted in an outer surface of the supporting portion of the head of the pile and an inner surface of the binding portion of the bottom portion of the footing in a closing state, and the metal parts are integrally connected to the head of the pile and the bottom of the footing via anchor members.

8. A pile foundation structure according to claim 1, wherein metal parts made of a metal are respectively fitted in an outer surface of the supporting portion of the head of the pile and an inner surface of the binding portion of the bottom portion of the footing in a closing state, and the metal parts are integrally connected to the head of the pile and the bottom of the footing via anchor members.

9. A pile foundation structure according to claim 1, wherein the sliding member is made of a material being self-lubricative.

10. A pile foundation structure having a footing arranged on a side of a head of a pile in the underground comprising:

a spherical-supporting-portion being convex or concave shaped, disposed on the head of the pile so as to protrude above an upper surface of the underground, a spherical-binding-portion being convex or concave shaped, disposed on a bottom portion of the footing separated from the pile so as to correspond to the spherical-supporting-portion and be greater than the corresponding spherical-supporting-portion, and a sliding member interposed between an outer surface of the spherical-supporting-portion and an inner surface of the spherical-binding-portion, thereby building a pin bearing structure for making it possible to relatively slidingly rotate the binding portion of the head of the pile, wherein protrusive seat-shaped and recessed seat-shaped metal parts are respectively fitted in an outer surface of said spherical-supporting-portion of the head of the pile and an inner surface of said spherical-binding-portion of the bottom portion of the footing in a closing state, and wherein the metal parts are integrally connected to the head of the pile and the bottom of the footing via anchor members.

11. A pile foundation structure according to claim 10, wherein a crushed-stone layer for supporting the footing so as to be horizontally movable, is formed between a bottom surface of the footing and the upper surface of the underground.

12. A pile foundation structure according to claim 11, wherein a calking compound is enclosed with the sliding surface between the spherical-supporting-portion of the head of the pile and the spherical-binding-portion of the bottom portion of the footing.

13. A pile foundation structure according to claim 10, wherein a calking compound is enclosed with the sliding surface between the spherical-supporting-portion of the head of the pile and the spherical-binding-portion of the bottom portion of the footing.

14. A pile foundation structure according to claim 10, wherein the sliding member is made of a material being self-lubricative.

* * * * *

UNITED STATES PATENT AND TRADEMARK OFFICE

CERTIFICATE OF CORRECTION

PATENT NO. : 6,102,627

DATED : August 15, 2000

INVENTOR(S) : Sakae Ueda et al

It is certified that error appears in the above-indentified patent and that said Letters Patent is hereby corrected as shown below:

Title page, item [73], the assignee "Nippon Pillar Packaging Co., Ltd." should be --Nippon Pillar Packing Co., Ltd.--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*